United States Patent [19]

Asano

[11] 4,019,470

[45] Apr. 26, 1977

[54] CLOSED LOOP AIR-FUEL RATIO CONTROL SYSTEM FOR USE WITH INTERNAL COMBUSTION ENGINE

[75] Inventor: Masaharu Asano, Yokohama, Japan

[73] Assignee: Nissan Motor Co., Ltd., Yokohama, Japan

[22] Filed: Feb. 5, 1976

[21] Appl. No.: 655,567

[30] Foreign Application Priority Data

Feb. 6, 1975 Japan ..... 50-15813
June 20, 1975 Japan ..... 50-74300

[52] U.S. Cl. ..... 123/32 EE; 123/119 EC; 60/276; 60/285

[51] Int. Cl.[2] ..... F02D 5/02

[58] Field of Search ..... 60/276, 285; 123/32 EE, 123/119 R, 119 E, 119 EC

[56] References Cited

UNITED STATES PATENTS 3,745,768 7/1973 Zechnall ..... 60/285
3,939,654 2/1976 Creps ..... 60/276

*Primary Examiner*—Douglas Hart
*Attorney, Agent, or Firm*—Lowe, King, Price & Markva

[57] ABSTRACT

In an electronic closed loop control system for optimally controlling the air-fuel mixture fed to an internal combustion engine, two electrical circuits are provided: one for removing cumbersome manual adjustment of a standard signal level for ensuring the system a proper air-fuel ratio control, and the other for ensuring the system a proper control during a certain period after initially energizing the system.

8 Claims, 12 Drawing Figures

CLOSED LOOP AIR-FUEL RATIO CONTROL SYSTEM FOR USE WITH INTERNAL COMBUSTION ENGINE

The present invention relates generally to an electronic closed loop control system for use with an internal combustion engine, and particularly to such a system for optimally controlling the air-fuel mixture fed to an internal combustion engine based on a sensed concentration of a component in exhaust gases.

Various systems have been proposed to optimally control the air-fuel ratio of the air-fuel mixture to an internal combustion engine in dependence of the modes of engine operation, one of which is to utilize the concept of an electronic closed loop control system based on a sensed concentration of a component in exhaust gases of the engine.

A conventional electronic closed loop control system generally comprises, an exhaust gas sensor for sensing a concentration of a component in exhaust gases and generating a signal representative thereof, an air-fuel ratio control unit connected to the exhaust gan sensor for deriving the signal therefrom and generating a signal indicative of an optimum air-fuel ratio based on at least the signal from the exhaust gas sensor, an electronic control unit connected to the air-fuel ratio control unit for deriving the signal therefrom and generating a control signal based on the signal from said air-fuel ratio control unit, and an actuator connected to the electrical control unit to optimally control an air-fuel mixture fed to the engine in dependence of the control signal derived therefrom.

In the above-described prior art, however, a problem is encountered as is described below. The signal from the air-fuel ratio control unit, which signal indicates an optimum air-fuel mixture ratio, is different in every system even if the elements of the system are severely standardized, and furthermore, the signal is liable to undesirably change from a preset level due to change of characteristics of electrical components with the passage of time. Consequently, in the conventional system, the signal in question of each individual system should be manually adjusted to ensure the system a proper operation.

It is therefore an object of the present invention to provide an electronic closed loop air-fuel ratio control system with an electronic circuit in order to supersede the need for a cumbersome adjustment of the system.

Another object of the present invention is to provide an electronic closed loop air-fuel ratio control system with an electronic circuit in order to ensure the system a proper control during a certain period after initially energizing the system.

These and other objects, features and many of the attendant advantages of this invention will be appreciated more readily as the invention becomes better understood by the following detailed description, wherein like parts in each of the several figures are identified by the same reference characters, and wherein:

FIG. 1 schematically illustrates a conventional electronic closed loop control system for regulating the air-fuel ratio of the air-fuel mixture fed to an internal combustion engine equipped with a fuel injector;

FIG. 2 schematically illustrates another conventional electronic closed loop control system for regulating the air-fuel ratio of an air-fuel mixture fed to an internal combustion engine equipped with a carburetor;

FIG. 3 schematically illustrates a block diagram of a unit involved in both the systems of FIGS. 1 and 2;

FIGS. 4*a*–4*c* show several waveforms and voltage levels developed at or derived from the elements of FIG. 3;

Figure 6:
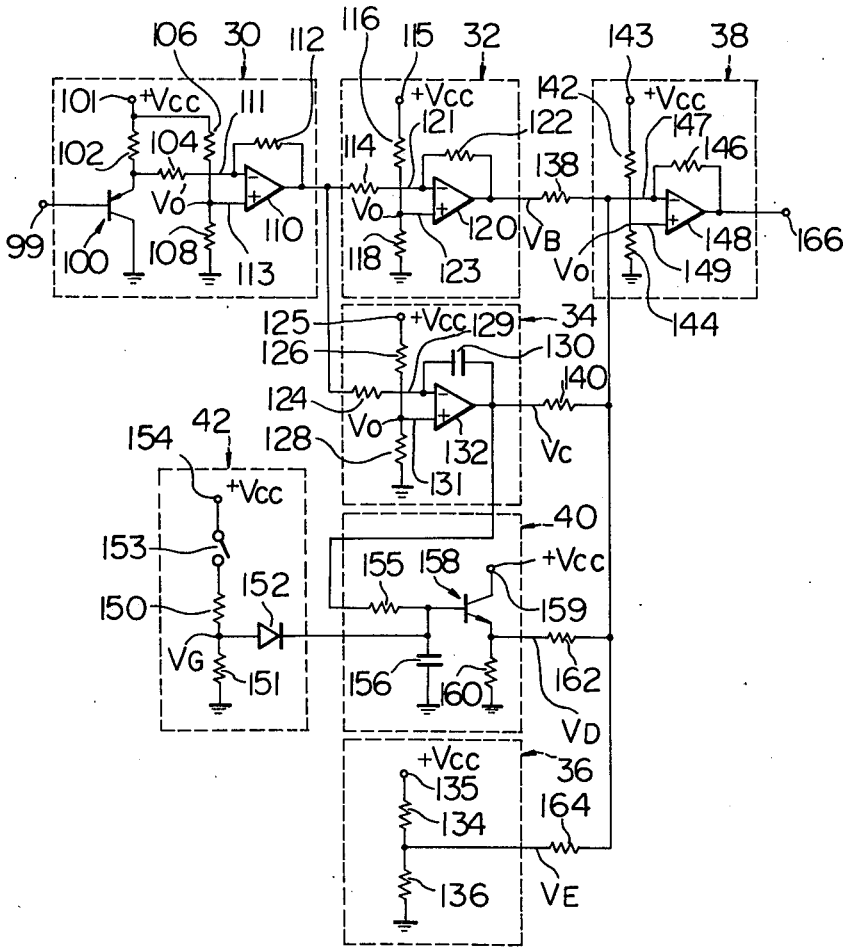
FIG. 6 illustrates a detailed circuit embodying the present invention.

FIGS. 7*a*–7*d* schematically illustrate several waveformms and voltage levels developed at or derived from the circuit of FIG. 6.

Figure 1:
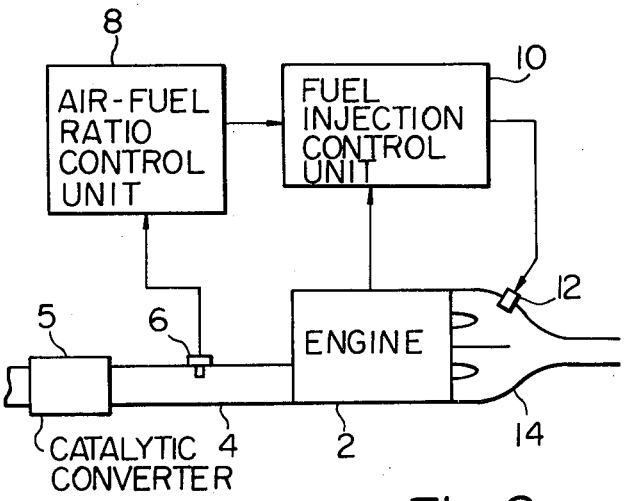

Reference is now made to drawings, first to FIG. 1, which schematically illustrates in a block diagram an example of a conventional electronic closed loop fuel injection system with which the present invention is concerned. The purpose of the system of FIG. 1 is to electrically control the air-fuel ratio of an air-fuel mixture supplied to an engine 2 through a fuel injector 12. An exhaust gas sensor 6, such as an oxygen analyzer, is disposed in an exhaust pipe 4 in order to sense the concentration of a compact in exhaust gases. An electrical signal derived from the sensor 6 is fed to an air-fuel ratio control unit 8 which generates an electrical signal representative of differential between the magnitudes of the signal from the sensor 6 and a reference signal. The magnitude of the reference signal is previously determined in due consideration of optimum air-fuel ratio of the air-fuel mixture supplied to the engine 2 for maximizing the efficiency of, for example, a three-way catalytic converter 5. The catalytic converter 5 is provided in the exhaust pipe 4 downstream of the sensor 6. The signal from the air-fuel ratio control system 8 is then fed to a fuel injection control unit 10. The control unit 10 receives various signals from various sensors (not shown) provided around the engine 2. The signals from the sensors indicate the amount of sucked air, a throttle position, engine speed, engine temperature, and intake manifold vacuum etc. The control unit 10 is programmed to determine an optimum opening duration of the fuel injector 12 for ensuring, for example, effective reduction of noxious components in exhaust gases. The determination of the opening duration is based on the signals from the various sensors and also the signal from the air-fuel ratio control unit 8. Then, the control unit 10 generates a train of command pulses each of which represents the optimum opening duration of the injector 12. The train of command pulses thus generated is fed to the next stage, viz., the fuel injector 12 located in an air-fuel mixture induction pipe 14, thereby to optimally control the air-fuel mixture ratio under all engine operation modes.

Figure 2:
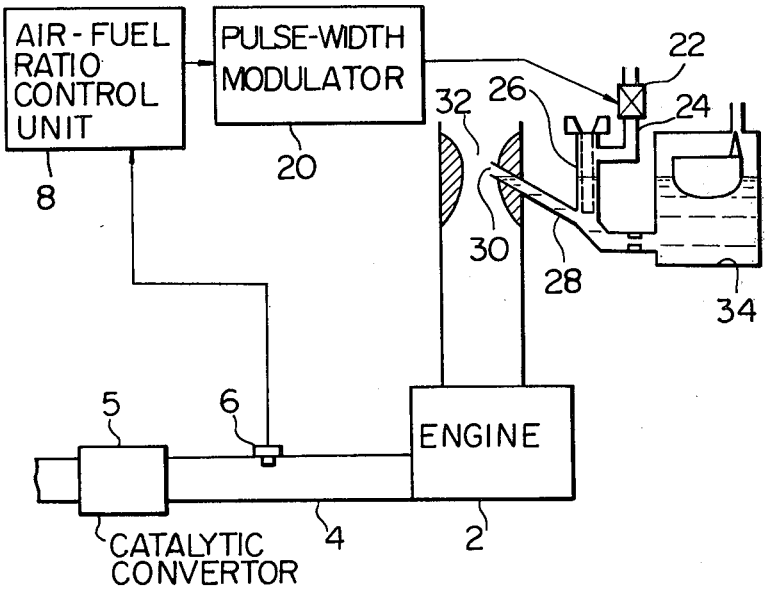

In FIG. 2, there is schematically illustrated in a block diagram an example of a conventional electronic closed loop carburetor system with which the present invention is also concerned. The purpose of this system is to electrically control the air-fuel ratio of an air-fuel mixture supplied to the engine 2 through a carburetor (no numeral). A function of the system of FIG. 2 is the same as in the system of FIG. 1 until the generation of the signal from the air-fuel ratio control unit 8, so that further description thereabout will be omitted for brevity.

The signal from the air-fuel raito control system 8 is fed to a pulse width modulator 20 which also receives a dither signal from a dither signal generator (not shown) to generate a train of command pulses. The train of command pulses is then fed to an electromagnetic valve 22 in order to regulate the air-fuel mixture ratio. The electromagnetic valve 22 is provided in an air passage 24. The air passage 24 is connected at one end thereof to an air bleed chamber 26, so that the command pulses control the amount of air flowing into a fuel passage 28. The fuel passage 28 terminates at one end thereof at a discharging nozzle 30 and extends between a venturi 32 and a float bowl 34. The train of a command pulses thus actuates the electromagnetic valve 22 to regulate the air-fuel mixture ratio for ensuring proper engine operations to effectively reduce noxious components. In the above, the carburetor system can be modified as follows: the fuel passage 28 is bypassed, with or without the electromagnetic valve 22, by providing another fuel passage (not shown) having an orifice different from that of the passage 28, and then, two electromagnetic valves are provided in each of the two fuel passages to alternatively allow fuel flow to the venturi 32 from the float bowl 34 through either of the two passages in response to the command pulses from the pulse width modulator 20.

Figure 3:
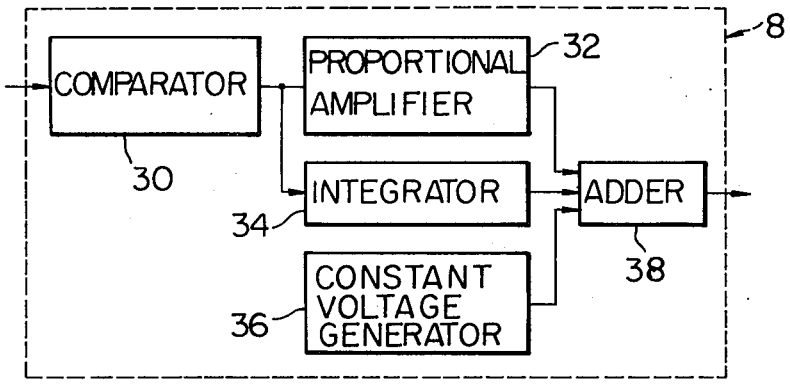
Figure 4A:
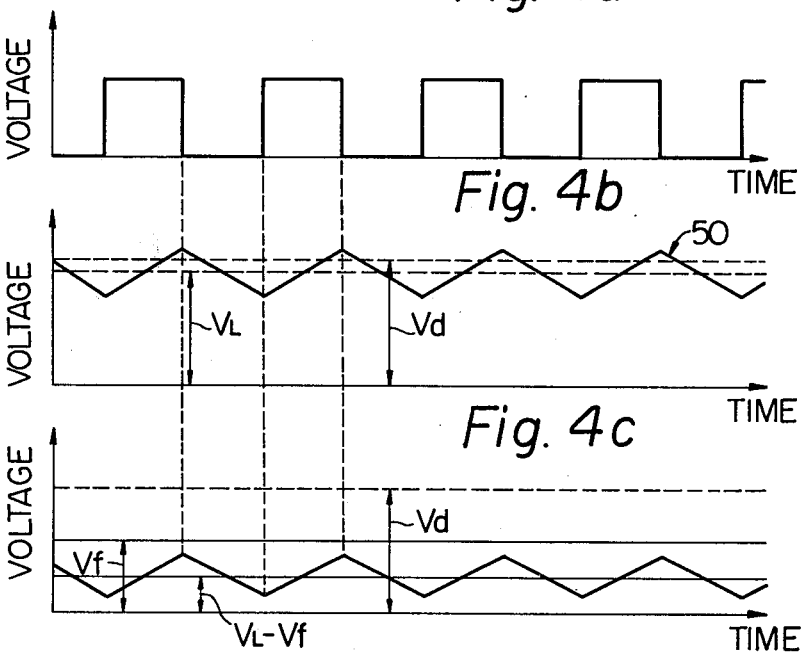

In FIG. 3, there is illustrated in a block diagram a somewhat detail of the conventional air-fuel ratio control unit 8 of FIGS. 1 and 2, and in FIGS. 4*a*–4*c*, several waveforms and potential levels are shown which are generated or derived from elements of the control unit 8 of FIG. 3. A comparator (or a differential amplifier) 30 receives the electrical signal from the exhaust gas sensor 6, comparing the same with the reference value to generate an electrical signal. The electrical signal represents the differential therebetween. The signal from the comparator 30, the waveform of which is depicted in FIGS. 4*a*, is fed to next two stages, viz., a proportional amplifier 32 and an integrator 34. The proportional amplifier 32 is provided for improving the efficiency of the electrical closed loop control system, in other words, for facilitating a rapid transient response of the system. The integrator 34 integrates the signal from the comparator 30, generating an integrated output signal the waveform of which is indicated by reference numeral 50 in FIG. 4*b*. As shown in FIG. 3, a constant voltage generator 36 is provided for the purpose of regulating an operation level $V_L$ of the integrator 34 by a constant voltage $V_f$. This is actually done by adding $V_f$ to an adder 38. The purpose of the provision of the constant voltage generator 36 is to remove a possibility: the output signal of the integrator 34 is undesirably clipped at a maximum level $V_d$ in FIG. 4*b*) of the operation range of the integrator 34. FIG. 4*b* illustrates a case in the absence of the constant voltage generator 36 wherein the crest of the output signal of the integrator 34 exceeds the maximum level $V_d$. On the other hand, in FIG. 4*c*, the operation level of the integrator 34 is lowered by $V_f$ compared with the case as shown in FIG. 4*b*. As a result, the possibility of the undesired clipping at $V_d$ can be avoided.

The level $V_L$, which is previously determined by a system designer, indicates an optimum air-fuel mixture ratio for maximizing the efficiency of the three-way catalytic converter 5. The signals from the three elements, that is, proportional amplifier 32, the integrator 34, and the constant level generator 36, are applied to the adder 38 to be added together. The output signal of the adder 38 is fed to the fuel injection control unit 10 and used for determining a a proper pulse width of each of the command pulses. The command pulses are then fed to the fuel injection 12 (FIG. 1) or the electromagnetic valve 22 (FIG. 2).

Figure 5:
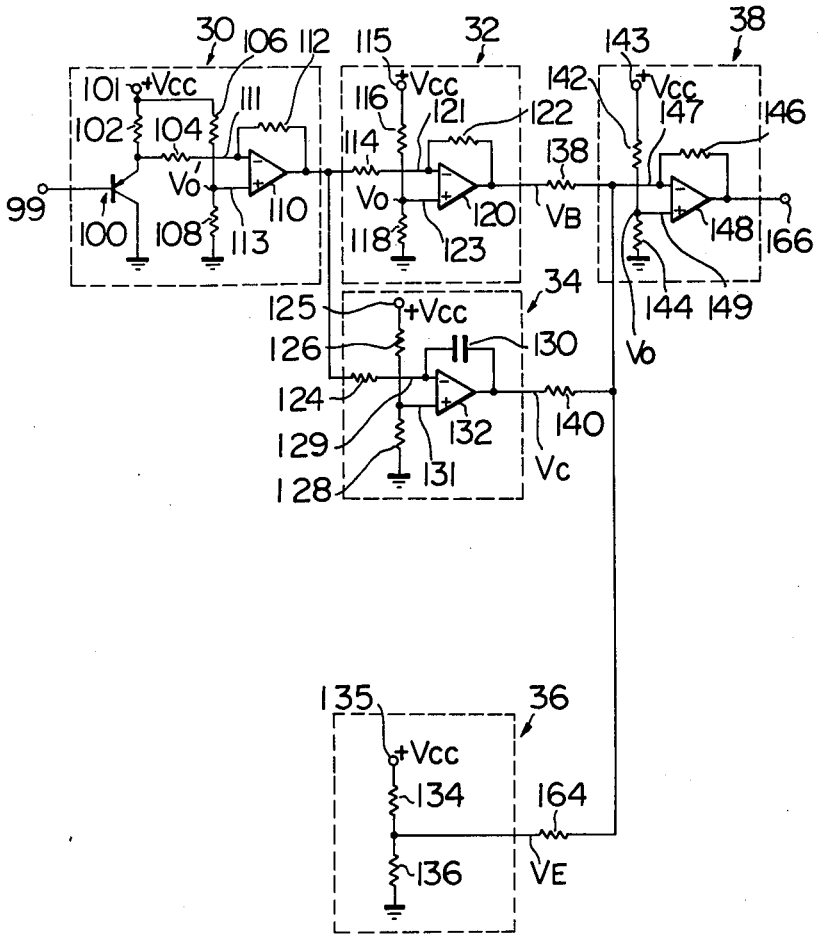
FIG. 5 illustrates a detailed circuit of the elements of FIG. 3.

FIG. 5 illustrates an example of a circuitry of the conventional air-fuel ratio control unit 8 or FIG. 3 with which the present invention is directly concerned. The circuit of FIG. 5 is well known to those skilled in the art, so that a simple description thereof will be made hereinafter. In the following, it is to be noted that the circuit of FIG. 5 is only an example and various modifications be made within the scope thereof.

The output signal from the exhaust gas sensor 6 is fed to the base of a transistor 100 of the comparator 30 through an input terminal 99. The transistor 100 has the collector connected directly to the ground and the emitter connected to a positive power source (not shown) through a resistor 102 and a thermal 101. It is apparent that the transistor 100 can be omitted if the output signal from the exhaust gas sensor 6 be sufficiently large. The emitter of the transistor 100 is connected through a resistor 104 to an inverting input terminal 111 of an operational amplifier 110 across which a feedstock resistor 112 is connected. A voltage divider consisting of resistors 106 and 108 is interposed between the terminal 101 and the ground for providing the reference value, viz., a constant voltage $V_o'$ to a non-inverting input terminal 113 of the operational amplifier 110. The operational amplifier 110 comprises the signal from the transistor 100 with $V_o'$ to generate a signal indicating a differential therebetween. The output signal of the comparator 30 is then fed to the proportional amplifier 32 through a resistor 114 and also the integrator 34 through a resistor 124. An operational amplifier 120 of the proportional amplifier 32 has an inverting a non-inverting input terminals 121 and 123 which are respectively connected to the resistor 114 and a junction between resistors 116 and 118. The resistors 116 and 118, which are connected between a terminal 115 and the ground, form a voltage divider to apply a voltage $V_o$ to the terminal 123. A resistor 122 is connected across the amplifier 120. An operational amplifier 132 of the integrator 34 receives the output signal of the comparator 30 at its inverting input terminal 129 through the resistor 124 and also a constant voltage $V_o$ appearing at a junction between resistors 126 and 128 at its non-inverting input terminal 131. The resistors 126 and 128 are connected in series between a terminal 125 and the ground. A capacitor 130 is connected across the operational amplifier 132. As shown, the constant voltage divider 36 generates a constant voltage $V_E$ at a junction between resistors 134 and 136, which resistors are connected in series between a terminal 135 and the ground. The output voltages from the operational amplifiers 120, 132 ($V_B$ and $V_C$, respectively) and the constant voltage $V_E$ are fed to an inverting input terminal 147 of an operational amplifier 148 through respective resistors 138, 140 and 164. A non-inverting input 149 of the operational amplifier 148 receives a constant voltage $V_o$ appearing at a junction between resistors 142 and 144. The resistors 142 and 144 are connected in series between a terminal 143 and the ground. A resistor 146 is connected across the amplifier 148. The output signal of the adder 38 is then fed to the fuel injection control unit 10 (FIG. 1) or the pulse width modulator 20 (FIG. 2).

In the above-described conventional system, however, a defect inherent therein can be pointed out as follows. That is, the voltage $V_L$ indicative of an optimum air-fuel mixture ratio is different in every system even if the elements forming the system are severely standardized. Furthermore, the present voltage $V_L$ is liable to undesirably change with the passage of time. Consequently, in the conventional system, the voltage $V_f$ of each individual system should be manually adjusted to ensure a proper operation of the integrator 34 for efficiency of the system.

Therefore, according to the present invention, two new electrical circuits are provided in the conventional air-fuel ratio control unit 8: one is for removing the inherent defect of the need for cumbersome manual adjustment of the voltage $V_f$, and the other for ensuring proper initial operation of the first-mentioned new circuit.

Reference is now made to FIG. 6, in which a preferred embodiment of the present invention is illustrated. As seen from the circuit of FIG. 6, a smoothing circuit 40 and a quick charging circuit 42 are added to the circuit of FIG. 5. In brief, the smoothing circuit 40 is for removing the aforementioned manual adjustment of the voltage $V_f$, and, on the other and, the quick charging circuit 42 is for rapidly bringing the operation of the smoothing circuit 50 (in other words, the system in question) into a normal state upon energization of the system.

As shown in FIG. 6, a transistor 158 receives the output signal of the integrator 34 at the base thereof through a resistor 155. The collector of the transistor 158 is connected to the power source through a terminal 159, and, whilst, the emitter thereof is connected to the ground through a resistor 160. A capacitor 156 is interposed between one end of the resistor 155 and the ground for smoothing the output signal of the integrator 34 together with the resistor 155. The smoothing circuit 40, therefore, is to smooth the output signal of the integrator 34 and then to amplify the smoothed signal by, for example, a factor of "K". In the meanwhile, one terminal of the capacitor 156 is connected to a cathode of a rectifier such as a diode 152, the anode of which is in turn connected to a junction of a voltage divider consisting of resistors 150 and 151. The resistors 150 and 151 are connected in series through a switch (such as an ignition switch ) 153 to the power source over a terminal 154 and to the ground. The quick charging circuit 42 serves to quickly charge the capacitor 156 upon closing the switch 153 by adding a voltage $V_G$ thereto.

Figure 7A:
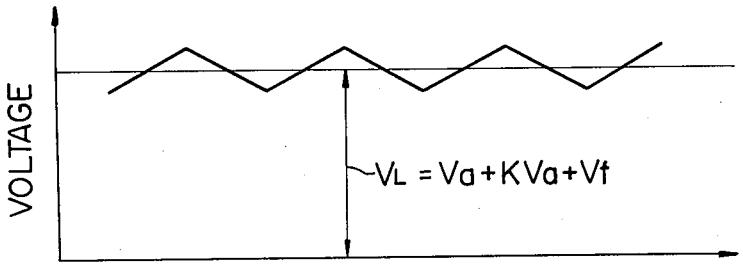
Figure 7B:
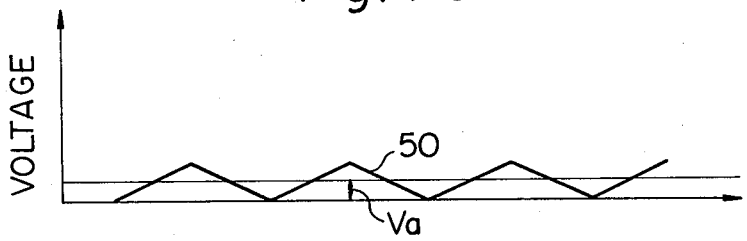
Figure 7C:
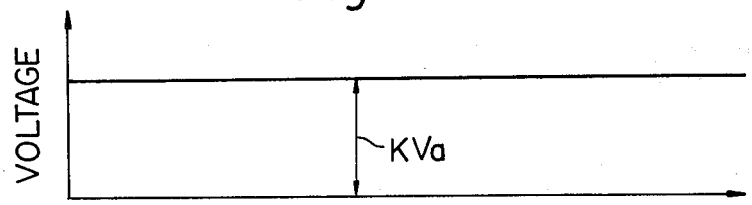
Figure 7D:
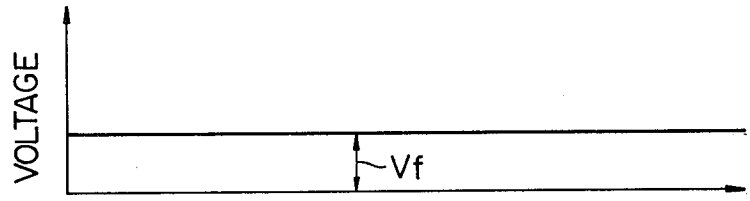

In the following, at first hand, the function of the smoothing circuit 40 will be described in detail in conjunction with FIGS. 6 and 7, wherein, however, the function of the proportional amplifier 32 is not referred to for brevity. In FIG. 7*b*, there is schematically illustrated the waveform of the output signal of the integrator 34 (depicted by reference numeral 50) and also the operation level thereof $V_a$ ($=V_L-V_f$)(FIG. 4). In FIGS. 7*c* and 7*d*, output voltage levels of the smoothing circuit 40 and the constant voltage generator 36 are illustrated, respectively. These output voltages are then fed to the adder 38, the output signal of which is shown in FIG. 7*a*. In this case, assuming that (1) the voltage $V_L$ is charged by $\Delta V_L$ in dependence of the signal from the exhaust gas sensor 6 (FIGS. 1 and 2), and (2) the voltages $V_a$ and $KV_a$ change respectively by $\Delta V_a$ and $\Delta KV_a$ as a result of the change of $V_L$, then we obtain the following equation:

$$\Delta V_L = \Delta V_a + \Delta KV_a$$

Therefore, if K = 1, we obtain $\Delta v_a = \frac{1}{2}\Delta V_L$. Furthermore, if K is noticeably large, $\Delta V_a << \Delta KV_a$. These mean that, even if $\Delta V_L$ is large, $\Delta V_a$ is within a small range, so that the manual adjustment of the voltage $V_f$ is no longer required due to the small change of $V_a$ despite the large change of $V_L$.

On the other hand, the purpose of the provision of the quick charging circuit 42 is, as previously described, to quickly charge the capacitor 156 of the smoothing circuit 40 for ensuring a proper operation of the system upon energizing the same. Before describing a significant feature of the quick charging circuit 42 according to the present invention, a defect will be described which occurs in the absence of the circuit 42. That is, a desired air-fuel mixture ratio control of the system could not be attained until the capacitor 156 is charged to a predetermined level when the system is initially energized (usually, taking tens of seconds), because a time constant of the smoothing circuit 40 is considerably large. In the following, to make clear the significant feature of the quick charging circuit 42, the following equation is shown.

$$V_F = V_o - [K_1(V_B - V_o) + K_2(V_C - V_o) + K_3(V_D - V_o) + K_4(V_E - V_o)]$$

where $V_F$: output voltage of the adder 38,

$K_1 - K_4$: constants, $V_D$: output voltage of the smoothing circuit 40.

In order to quickly bring the system into a normal state after initially energizing the system $V_F$ of the above equation should be brought to a predetermined level as soon as possible. However, in the absence of the quick charging circuit 42, the normal state of the system is not quickly attained. This is because, especially, $V_C$ does not quickly rise due to a large time constant of the smoothing circuit 40, so that $V_F$ is undesirably maintained large during, for example, about tens of seconds after the initial energization of the system, resulting in the fact that the air-fuel ratio becomes much smaller than a desired value due to large voltage of $V_F$.

To avoid the above-described defect, the quick charging circuit 42 is provided which starts to charge the capacitor 156 through the diode 152 upon closing the switch 153 (such as an ignition switch). Therefore, provided that the voltage $V_G$, which develops at the junction between the resistors 150 and 151, is determined to be substantially equal to a voltage across the capacitor 156 at its normal state, then the system ensures a proper air-fuel mixture ratio control during the initial period in question.

In the above, the smoothing circuit 40 can be replaced by a circuit consisting of passive components such as a resistor and a capacitor. Using this circuit has advantages of low cost and very wide operational range compared with the smoothing circuit 40.

From the foregoing, the preferred embodiment of the present invention can remove the manual adjustment of the constant voltage $V_F$ and also ensures a proper control of the system during a certain period after initial energization of the system.

What is claimed is:

1. An electronic closed loop control system for supplying an optimum air-fuel mixture to an internal combustion engine, which system includes in combination, an exhaust gas sensor for sensing a concentration of a component in exhaust gases and generating a signal representative thereof, an air-fuel ratio control unit connected to said exhaust gas sensor for deriving the signal therefrom and generating a signal indicative of an optimum air-fuel ratio based on the signal from said exhaust gas sensor, an actuator control unit connected to said air-fuel ratio control unit for deriving the signal therefrom and generating an actuator controlling signal based on at least the signal from said air-fuel ratio control unit, and an actuator connected to said actuator control unit to optimally control an air-fuel mixture to said internal combustion engine in dependence of said actuator controlling signal, wherein an improvement comprises:

said air-fuel control unit including in combination, first means connected to said exhaust gas sensor deriving the signal therefrom to compare the same with a reference value and generating a signal representing a differential therebetween, second means including an integrator which is connected to said first means and receives the signal therefrom to integrate the same with respect to time and then generates an integrated signal, third means connected to said second means receiving said integrated signal to smooth the same, and fourth means connected to said second and third means and receiving and adding the signals from respective means, said fourth means being connected to said actuator control unit for applying its output signal thereto.

2. An electronic closed loop control system claimed in claim 1, in which said air-fuel ratio control unit further comprises means connected to said third means for quickly energizing said third means in order to quickly being the system to a normal operation mode upon energizing the system.

3. An electronic closed loop control system claimed in claim 1, in which said actuator is at least one injection valve provided in an intake manifold terminating at one end thereof at said internal combustion engine.

4. An electronic closed loop control system claimed in claim 1, in which said actuator is at least one electromagnetic valve provided in a carburating system.

5. An electronic closed loop control system for supplying an optimum air-fuel mixture to an internal combustion engine, which system includes in combination, an exhaust gas sensor for sensing a concentration of a component in exhaust gases and generating a signal representative thereof, an air-fuel ratio control unit connected to said exhaust gas sensor for deriving the signal therefrom and generating a signal indicative of an optimum air-fuel ratio based on the signal from said exhaust gas sensor, a fuel injection control unit connected to said air-fuel ratio control unit for deriving the signal therefrom and also connected to sensors provided in the engine for deriving signals representing engine operation modes, and generating a control signal based on the signals from both said air-fuel ratio control unit and said sensors, and a fuel injection valve connected to said fuel injection control unit to optimally control an air-fuel mixture to said internal combustion engine in dependence of said control signal derived therefrom.

wherein an improvement comprises:

said air-fuel control unit including in combination, first means connected to said exhaust gas sensor deriving the signal therefrom to compare the same with a reference value and generating a signal, second means including an integrator which is connected to said first and receives the signal therefrom to integrate the same with respect to time and then generates an integrated signal, third means connected to said second means receiving said integrated signal to smooth the same, fourth means generating a signal with a constant voltage for determining a proper operating level of said third means, and fifth means connected to said second, third, and fourth means and receiving and adding the signals from respective means, said fifth means being connected to said fuel injection control unit for applying its output signal thereto.

6. An electronic closed loop control system claimed in claim 5, in which said air-fuel ratio control unit further comprises sixth means connected to said third means for quickly charging said third means in order to quickly bring the system to a normal operation mode upon energizing the system.

7. An electronic closed loop control system for supplying an optimum air-fuel mixture to an internal combustion engine, which system includes in combination, an exhaust gas sensor for sensing a concentration of a component in exhaust gases and generating a signal representativve thereof, an air-fuel ratio control unit connected to said exhaust gas sensor for deriving the signal therefrom and generating a signal indicative of an optimum air-fuel ratio based on the signal from said exhaust gas sensor, a carburetor control unit including a pulse with modulator which is connected to said air-fuel ratio control unit for deriving the signal therefrom and generating a control signal based on the signal from said air-fuel ratio control unit, and at least one electromagnetic valve connected to said pulse width modulator to optimally control an air-fuel mixture to said internal combustion engine in dependence of said control signal derived therefrom, wherein an improvement comprises:

said air-fuel ratio control unit including in combination, first means connected to said exhaust gas sensor deriving the signal therefrom to compare the same with a reference value and generating a signal, second means including an integrator which is connected to said first means and receives the signal therefrom to integrate the same with respect to time and then generates an integrated signal, third means connected to said second means receiving said integrated signal to smooth the same, fourth means generating a signal with a constant voltage for determining a proper operating level of said third means, and fifth means connected to said second, third, and fourth means and receiving and adding the signals from respective means, said fifth means being connected to said carburetor control unit for applying its output signal thereto.

8. An electronic closed loop control system claimed in claim 7, in which said air-fuel ratio control unit further comprises sixth means connected to said third means for quickly charging said third means in order to quickly bring the system to a normal operation mode upon energizing the system.

* * * * *